US007806371B2

(12) United States Patent
Troutman

(10) Patent No.: US 7,806,371 B2
(45) Date of Patent: Oct. 5, 2010

(54) REMOTE CONTROL MODEL AIRCRAFT WITH LASER TAG SHOOTING ACTION

(76) Inventor: S. Clayton Troutman, 1566 Longpoint Rd., Pasadena, MD (US) 21122

( * ) Notice: Subject to any disclaimer, the term of this patent is extended or adjusted under 35 U.S.C. 154(b) by 489 days.

(21) Appl. No.: 11/999,963

(22) Filed: Dec. 7, 2007

(65) Prior Publication Data

US 2009/0050747 A1 Feb. 26, 2009

Related U.S. Application Data

(60) Provisional application No. 60/874,172, filed on Dec. 7, 2006.

(51) Int. Cl.
*B64C 13/02* (2006.01)

(52) U.S. Cl. ..... 244/190; 446/50

(58) Field of Classification Search ..... 244/190; 446/50, 57, 34, 175, 429
See application file for complete search history.

(56) References Cited

U.S. PATENT DOCUMENTS 3,238,663 A * 3/1966 Morrison ..... 446/31
4,709,884 A * 12/1987 Gustafson ..... 244/139
2009/0224094 A1* 9/2009 Lachenmeier ..... 244/13

* cited by examiner

*Primary Examiner*—Timothy D Collins
(74) *Attorney, Agent, or Firm*—Ober/ Kaler; Royal W. Craig

(57) ABSTRACT

The present invention is a radio-controlled (RC) model aircraft system with laser tag capabilities. A transmitter and receiver are each installed in at least two separate RC aircrafts. The transmitter on one aircraft emits an infrared light beam to the receiver on the other aircraft(s) that changes the infrared signal to a first servo to move an arm, which releases a model aircraft door behind which there are ribbons. The ribbons escape from the aircraft wings to show a hit. An optional second servo operate a smoke screen and eject a pilot to simulate actual combat. The system may also include audio and lighting effects to simulate firing and hit sequences with accompanying theatrical, physical effects including release of smoke and ribbons, and ejection of the pilot that realistically simulates air combat.

12 Claims, 7 Drawing Sheets

A

B

REMOTE CONTROL MODEL AIRCRAFT WITH LASER TAG SHOOTING ACTION

CROSS-REFERENCE TO RELATED APPLICATION(S)

The present application derives priority from U.S. provisional application Ser. No. 60/874,172 filed 7 Dec. 2006.

BACKGROUND OF THE INVENTION

1. Field of the Invention

The present invention relates to a remote control model aircraft, and more particularly to a remote control model aircraft having laser tag shooting capabilities.

2. Description of the Background

Radio-controlled (RC) aircraft are utilized for scientific, government, and military purposes to simulate actual combat in a safe manner or to act as spy planes. RC aircraft are also a growing hobby among model airplane enthusiasts. RC aircraft can be controlled remotely with a hand-held transmitter and receiver within the crafts. Prior art RC craft also incorporate other advanced technological devices to enable hobbyists to enjoy other gaming capabilities, such as laser tag. There has been one known patent effort in this regard.

United States Patent Application No. 20050186884 by Evans filed on Feb. 18, 2005 shows a remote control game system with remote control vehicles where one generates an offensive laser signal and in response, the other generates a hit signal. Responsive to the hit signal the vehicle will degrade operation of its offensive components. However, this does not closely simulate actual combat which typically involves releasing smoke and ejecting the pilot from the plane after the plane incurs a number of hits.

Thus, there remains a need for an RC model aircraft with laser tag shooting action including a hit/tag sequence that simulates highly realistic actual combat within the Association for Model Aviation (AMA) guidelines.

SUMMARY OF THE INVENTION

It is, therefore, the primary object of the present invention to provide a radio-controlled aircraft system with laser tag shooting action.

Another object of the present invention is to provide a radio-controlled aircraft system having firing and hit sequences with accompanying theatrical, physical effects including release of smoke and ribbons, and ejection of a pilot.

Yet another object of the present invention is to provide a radio-controlled aircraft system that realistically simulates air combat.

Still another object of the present invention is to provide a radio-controlled aircraft system that adapts a safe method of simulation.

Another object of the present invention is to provide a radio-controlled aircraft system that is fabricated of materials providing an appropriate degree of flexibility, resiliency, durability, and longevity.

An additional object of the present invention is to provide a radio-controlled aircraft system that may be relatively economically manufactured and sold to provide for widespread use.

These and other objects are accomplished by a radio-controlled system that introduces the challenge and excitement of laser tag to the hobby of model R/C aircraft. A transmitter and receiver are each installed in at least two separate RC aircrafts for simulated dogfight-style air combat. In use, each operator controls the near infrared (NIR) laser transmitter on their aircraft from their handheld RC controller. They maneuver for aim until the transmitter on one aircraft emits a laser-infrared light beam to the receiver on the other aircraft(s) to score a hit. The receiver activates a first servo to move an arm, which releases a model aircraft door behind which there are ribbons. The ribbons escape from the aircraft wings to show the hit. An optional second servo operates a smoke screen and ejects a pilot to more closely simulate actual combat. The system also includes a sound signaling device with light bulbs, and can include an online simulation component.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
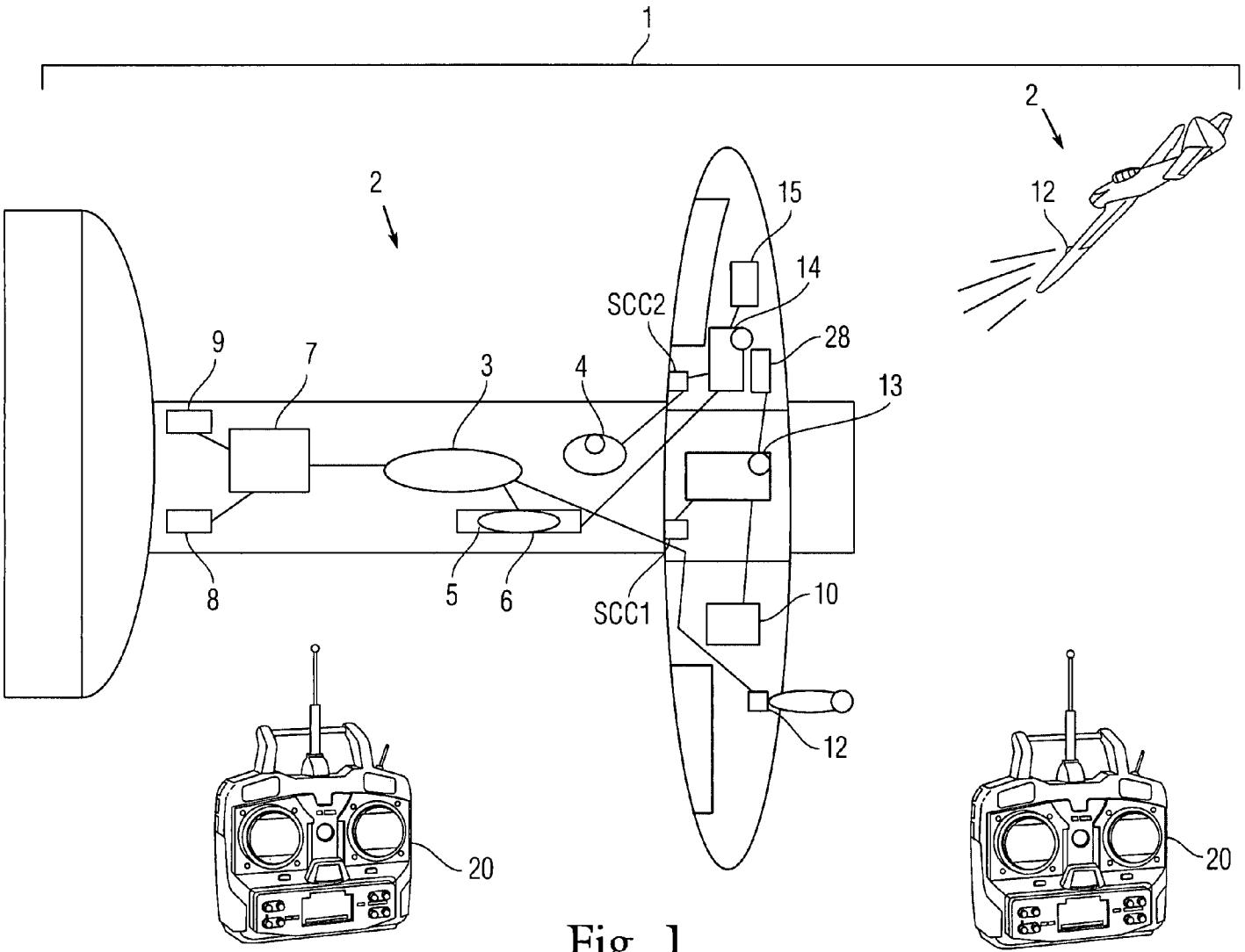
FIG. 1 is a diagrammatic view of a radio-controlled model aircraft system 1 having laser tag shooting action according to one exemplary embodiment of the present invention.

FIG. 1 is a diagrammatic view of a radio-controlled model aircraft system 1 having laser tag shooting action according to one exemplary embodiment of the present invention. The system 1 generally comprises one or more model radio-controlled (RC) aircraft 2 with accompanying radio controllers 20, each aircraft 2 being capable of laser tag shooting action 1 including a hit/tag sequence that simulates highly realistic actual dogfight-style combat, within the Association for Model Aviation (AMA) safety guidelines, by releasing smoke and ribbons 24 and ejecting a pilot assembly 6 to indicate the end of battle. The handheld radio controllers 20 are each conventional and include a pair of joysticks for controlling flight of the aircraft, plus at least one auxiliary firing control button. A variety of suitable handheld radio controllers 20 exist which include acceptable auxiliary control switches that will serve as an auxiliary firing control button.

As seen in the enlarged diagrammatic view of FIG. 1, each aircraft 2 further comprises a conventional model aircraft chassis with wings, gas engine, cockpit, and motion-control servos for controlling flight. In accordance with the present invention the aircraft is equipped with on-board processor 3, battery 7, an RC receiver and plurality of auxiliary servos as will be described for implementing the above-described hit/tag sequence.

Each RC aircraft 2 is additionally equipped with a near infrared (NIR) receiver 4 mounted aft of the cockpit, underneath the fuselage, and electrically connected to the processor 3. A NIR light source 12 such as a NIR laser diode is mounted externally atop one of the wings and is connected to the processor for selective illumination. The NIR light source 12 may be activated from the associated radio hand-held transmitter 20 and, when activated the light source 12 pulses on and off. The NIR receiver circuit 4 (described in further detail in reference to FIG. 3) on one airplane 2 is operative to respond to the frequency of the modulated pulse bursts of infrared light from the NIR light source 12 emanating from another airplane 2. Thus, a hobbyist controlling one airplane 2 from hand-held transmitter 20 can burst their NIR light source 12 during a realistic dogfight to achieve a laser tag shooting action upon the other airplane 2. Upon receiving a predetermined number or intensity of hits the other airplane 2 completes a hit sequence with accompanying theatrical, physical effects including release of smoke and ribbons, and ejection of the pilot. The net effect is a very realistic air combat simulation played out vicariously through multiple RC airplanes.

Figure 2:
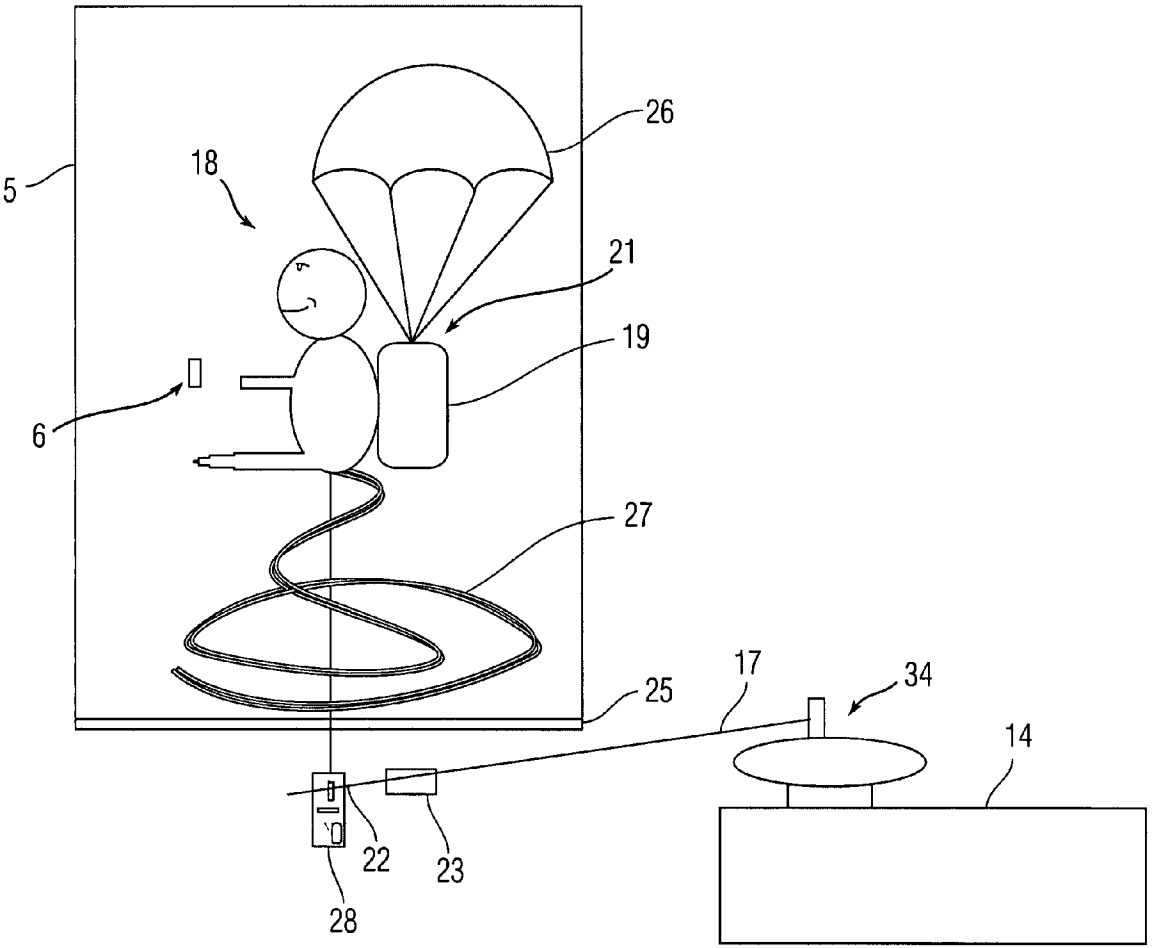
FIG. 2 illustrates the pilot ejection assembly 6.

FIG. 2 illustrates the pilot ejection assembly 6 in more detail, and this includes a pilot doll 18 having a backpack 19 for containing a parachute 20, the strings 21 of a parachute 20 being fixedly connected within the backpack 19. In order to avoid litter, it is preferable to make the pilot doll 18 of biodegradable material such as paper mache' and the parachute 20 of tissue paper so as not to clutter trees and fields. A cutout 5 in the fuselage (FIG. 1) houses the pilot ejection assembly 6, and within the cutout the pilot doll 18 sits atop a compressed spring 27. Within the fuselage, a servo mechanism (servo) 14 is connected to a pull pin release 26 for releasing the compressed spring 27. A push rod 17 is connected at one end to the servo arm 34 and is slidably inserted through a push rod guide 23 mounted in the fuselage. Any commercially available push rod guide 23 will suffice including the Dubro™ Micro Pushrod Guide. The push rod 17 extends there through and the tip is inserted into a release block 26, the release block being held back thereby. Various manufacturers make spring loaded pull pins which can be used with the present invention, including the Tite-Lok® spring-loaded pull pin. The push rod 17 comprises rubber, nylon, or any other tensile material that provides the requisite force and resistance to eject the pilot assembly 6 along with the pull pin 26 in a controlled, smooth movement with minimum friction. A nylon push rod 17, including the Sullivan Flex Gold-N-Rod, may be utilized to reduce thermal expansion and prevent radio interference, while still providing strength, flexibility, and lightness of weight. The release block 26 is connected by string or the like to the spring 27 and so long as the push rod 17 remains inserted in the release block 26 the spring 27 remains in compression and the pilot doll 18 sits. However, when the servo 14 is activated it pulls the push rod 17 tip out of release block 26 and releases the spring 27. In this manner the pilot ejection assembly 6 automatically ejects the doll 18, backpack 19 and furled parachute 20 at the end of an unsuccessful laser tag sequence. The cutout 5 may also include ribbons which can be released along with the pilot assembly 6.

Optionally, a light display 8 (such as an LED display) can be attached aft of the cockpit, underneath the fuselage to visually simulate adverse hits, and a sound signaling device 9 (e.g. a buzzer) can be included for audio effects. Both the sound signaling device 9 and light display 8 are electrically connected to the processor 3 for selective activation thereby. Mini EZ Connectors™ are conventional wire terminals that allow convenient retrofit electrical connection of the components of each airplane 2 and is generally intended that the above-described electronics be retrofit to an existing RC airplane.

In addition to the pilot ejection mechanism 6, ribbons 24 are released from first, second, and third receptacles 10, 28, 15 built into right and left forward wings and/or the fuselage. The location and size of the receptacles is a matter of design choice and may be varied based on the size of the airplane 2, and weight distribution considerations. A lid 29 is engaged by a similar pull pin release mechanism and pops open to release the ribbons 24. These receptacles 10, 28, 15 are described in further detail with respect to FIGS. 5 and 6. All ribbons 24 are yellow and red to signify fire, to more realistically simulate combat.

A near infrared (NIR) light source 12 is mounted on the topside of the right forward wing and is aimed forward to transmit a laser to a receiver 4 on an opposing aircraft 2. The light source 12 is preferably a laser diode, including for example the SDL 6300 Series High Brightness NIR Laser Diodes. The light source 12 is under operator-control from hand-held transmitter 20 and when activated the light source 12 pulses on and off. The receiver circuit 4 (described in further detail in reference to FIG. 3) is operative to respond to the frequency of the modulated pulse bursts of infrared light from the light source 12 of another airplane 2. The light source 12 and receiver 4 are electrically connected to the power source 7. Given good agility and aim, the infrared (IR) light beam pulsing from the light source 12 on one RC plane 2 strikes the receiver 4 of another RC plane 2. The maximum range of the light source 12 is 25 feet, in order to simulate a more realistic dogfight where warring fighter planes typically have to be in close proximity to shoot at each other. The receiver 4 may also receive the motion control signals from the hand-held transmitter 20 which controls the motion of that particular plane 2.

The receiver 4 is connected to the processor 3 which registers "hits" (optical signals input to receiver 4 at least five seconds apart). As described below, these hits cumulatively activate the servos to eject the pilot, release smoke or ribbons, and actuate lights and/or sound. Each hit is equivalent to winning a point in the game of laser tag. Every hit is part of a win sequence, similar to an actual battle.

The airplane 2 generally comprises two RC servos 13, 14, one for actuating the pilot ejection assembly 6 and one for releasing the ribbons 24 from the wings and/or the fuselage. If preferred either one of the servos 13, 14 may be used to the exclusion of the other, and thus the hit sequence would be reduced accordingly. Various manufacturers make servos 13, 14 which can be utilized in constructing the present invention and include the following: Airtronics, Futaba, JR Radio, Hitec.

Figure 3:
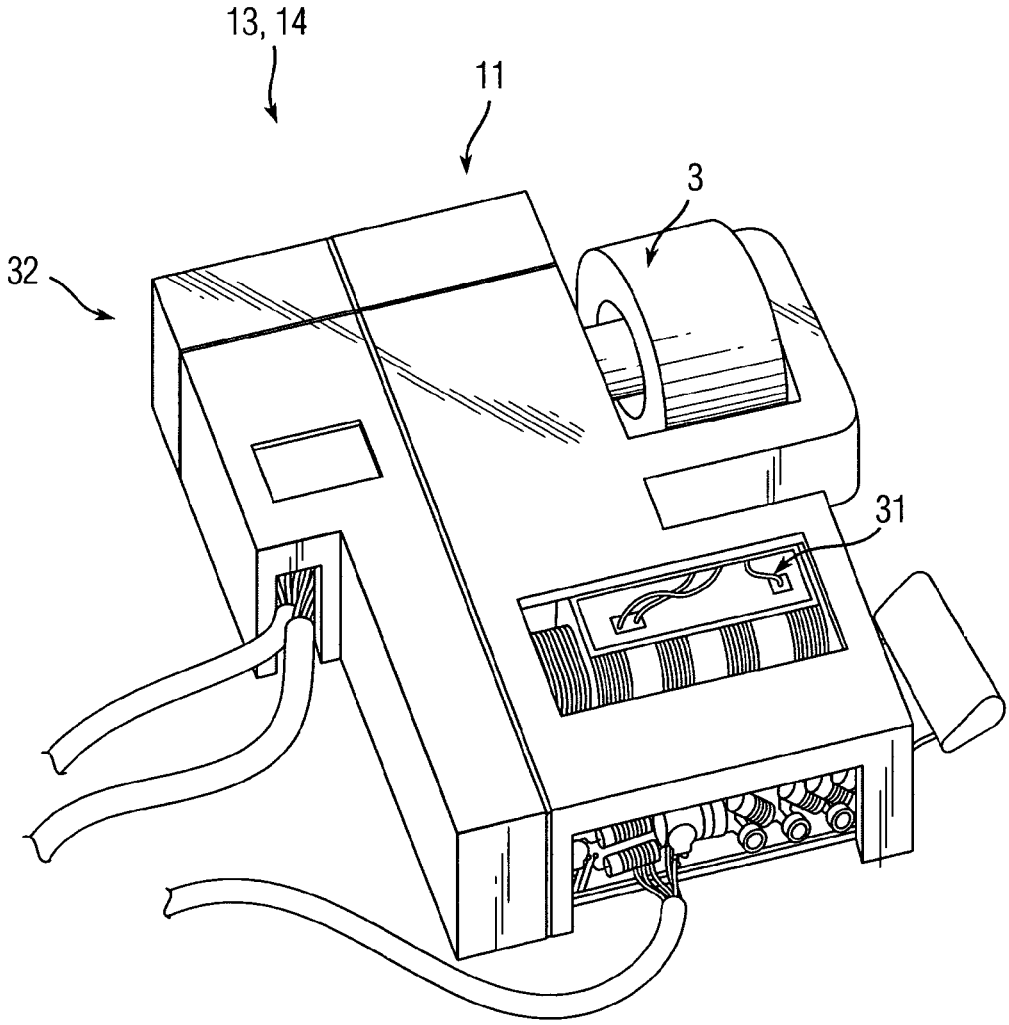
FIG. 3 is a perspective view of a conventional servo.

FIG. 3 is a perspective view of a conventional servo. Both servos 13, 14 are analog and comprise a DC motor 31 mechanically linked to a potentiometer 32. Additionally, the DC motor 31 drives the servo output wheel 3 by gears 11, all of which are assembled inside a plastic housing. The receiver 4 controls the servos 13, 14 based on the RF signals received from hand-held transmitter 20. When a servo 13, 14 is commanded to rotate (by signals sent by the receiver circuit 4), the DC motor 31 is powered until the potentiometer 32 reaches the value corresponding to the commanded position. Servos 13, 14 are connected by three wires: ground (black), power (red), and control (white), and operate based on the control signals sent over these control wires. A first servo 13 can be mounted in the cockpit to provide appropriate weight distribution in the aircraft 2. It is important for weight to be appropriately distributed and balanced in the plane 2 so that the plane 2 will fly well, and avoid crashing to the ground.

Servos 13, 14 each connect to a servo controller SCC1 and SCC2 via a control wire and servo controllers SCC1 and SCC2 both connect to the receiver 4 as described below. The angular motion of both the first 13 and second servos 14 will travel between the range of 0 to 180 degrees.

Figure 4:
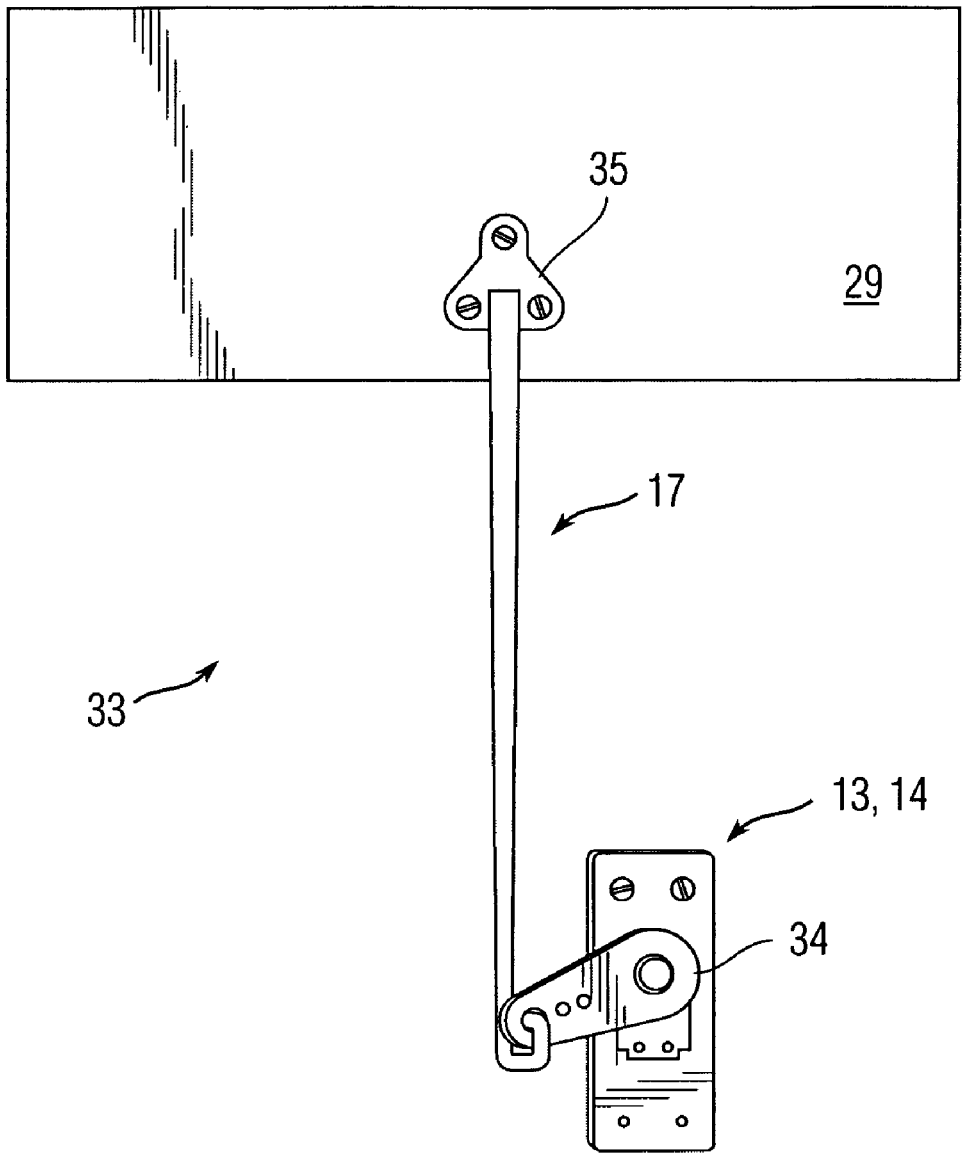
FIG. 4 is a diagrammatic view of an exemplary control arm attachment 33 for releasing the ribbons.

FIG. 4 is a diagrammatic view of an exemplary control arm attachment 33 for releasing the ribbons from first, second, and third receptacles 10, 28, 15. Servos 13, 14 are connected to the lid 29 of first 10 and second 28 receptacles, via a control arm attachment 33. Control arm attachment 33 is a lever attachment to the servo crankshafts. The attachments 33 may have one or more lever arms 34 to allow for multiple positions and also has a push rod 17 connected to the arm 34. The arm 34 transfers leverage from the servos 13, 14 to the push rod 17. Additionally, a hinged bracket 35 is mounted on the lids 29 of first 10 and second 28 receptacles and the other end of the push rod 17 is coupled thereto, to push/pull the lids 29. Push rods 17 are attached to hinged brackets 35 by clevises, ball joints, or any other suitable pivoting couplings. If desired, the hinged bracket 35 may include a lever arm coupled to the push rod 17 for imparting proper leverage to the lid 29.

Figure 5:
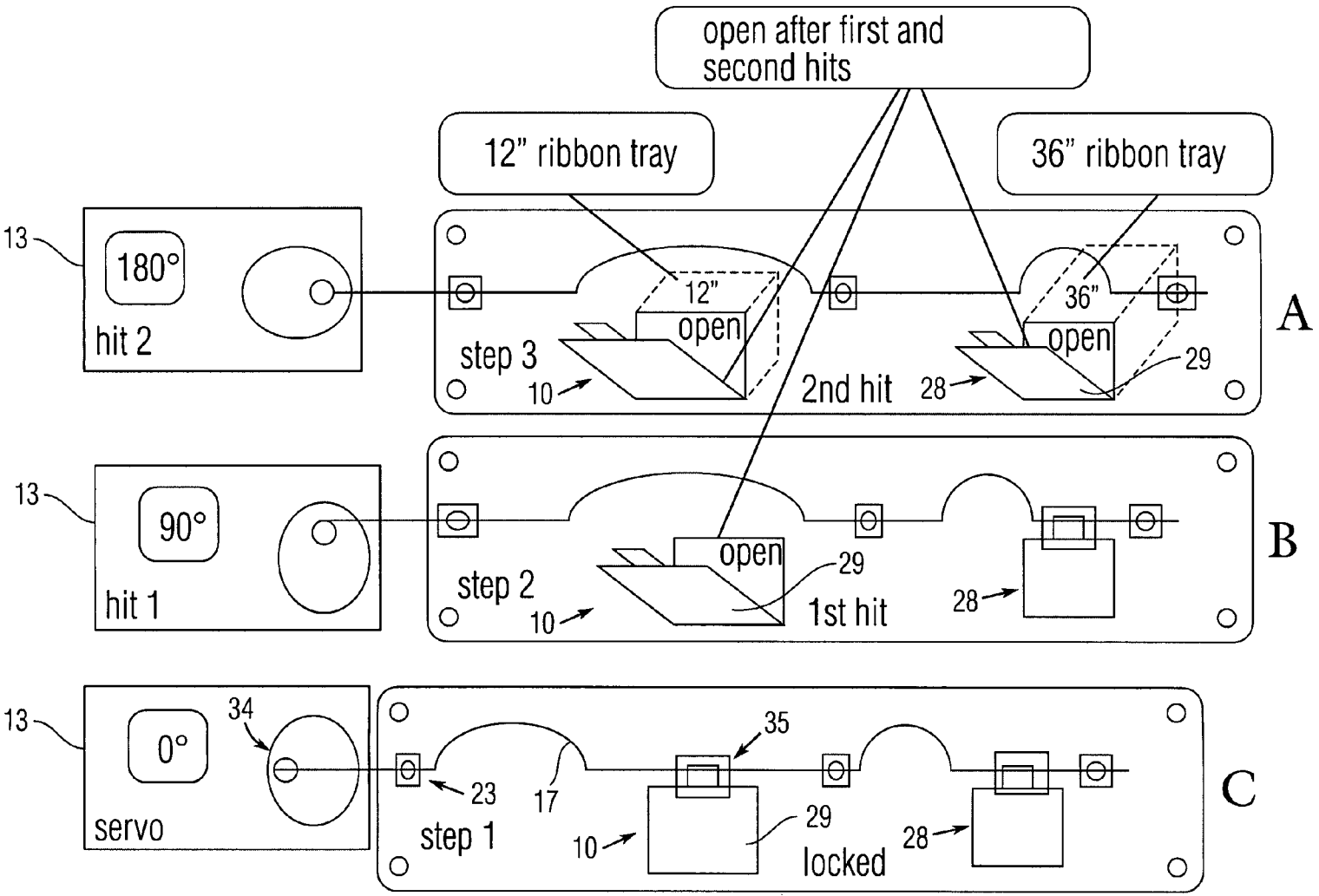
FIG. 5 (A-C) is a sequential schematic illustration of the first 10 and second receptacles 28 opening.

FIG. 5 (A-C) is a sequential schematic illustration of the first 10 and second receptacles 28 opening in response to first and second pulses, respectively from movement of first servo 13. Second servo 14 is mounted underneath the left forward wing in a similar manner.

Figure 6:
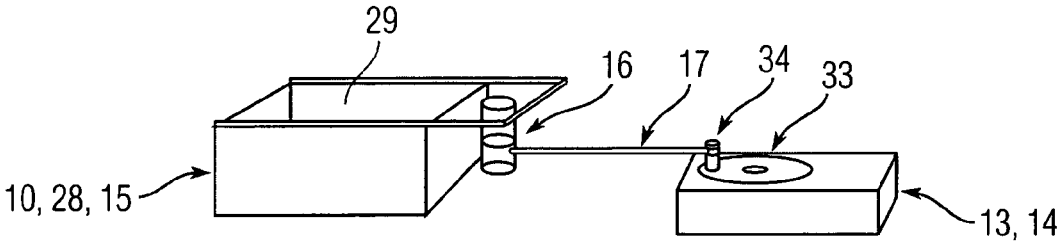
FIG. 6 (A-B) is a sequential perspective illustration of the receptacles 10, 28, 15 in closed position (A) and in an open position (B).
Figure 6:
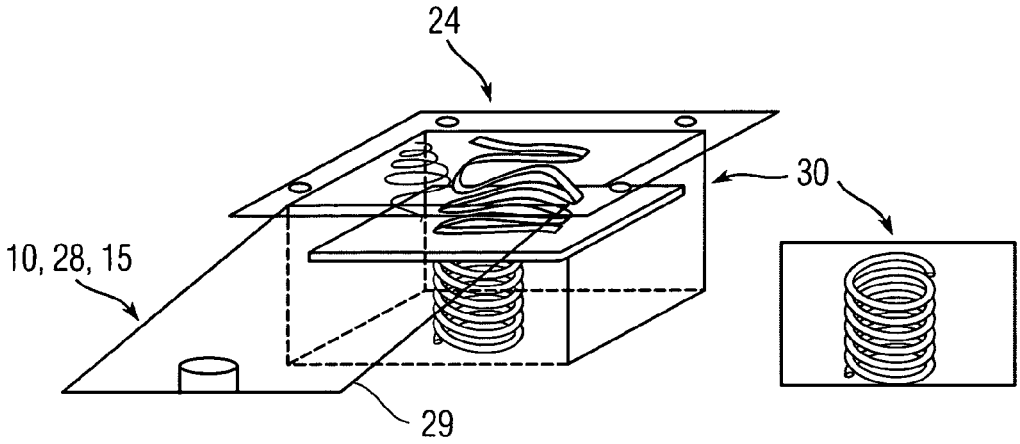

FIG. 6 (A-B) is a sequential perspective illustration of the receptacles 10, 28, 15 in closed position (A) and in an open position (B).

With collective reference to FIG. 5-6, the receptacles 10, 28, 15 are initially closed (5C and 6A). When the first servo 13 experiences a first pulse or "hit" as at 5(B), the servo 13 sets to its "neutral position" or 90 degrees, and moves the control arm attachment 33 which moves a guide plate 16 connected to the attachment 33 on one end and to a lid 29 on opposing end, upwards to push open the lid 29. Each pulse subsequent to the first pulse will be sent to servo 13, 14 at least five seconds after the immediately prior pulse even if the receiver 4 is constantly irradiated to demarcate hits. The mechanism for this timing interval between pulses is explained in greater detail below.

As seen at 5(B), a spring loaded tray 30 pushes ribbons 24 out of the receptacle 10, as the lid 29 opens. The ribbons 24 housed in the first receptacle 10 are preferably 12" long. FIG. 6(B) illustrates the open lid 29 of the receptacles 10, 28, 15.

As seen at 5(C), a second pulse moves the servo 13 from 90 to 180 degrees and opens the second receptacle filled with ribbons 24. The ribbons 24 in the second receptacle 28 are preferably 36" long. All ribbons 24 are yellow and red to signify fire, to more realistically simulate combat. The receptacles 10, 28, 15 may also house coal dust and/or release smoke along with the ribbons 24. The bottom of receptacle 15 around the spring tray 30 can be omitted if only smoke rather than (48") ribbons 24 are intended to be released.

A control arm attachment 33 connects the second servo 14 to the guide plate 16 attached to the lid 29 of receptacle 15. When the second servo 14 experiences a third pulse, servo 14 moves from 0 to 90 degrees which moves the control arm attachment 33 and consequently the guide plate 16 moves upward to push open the lid 29 of the receptacle 15 and the smoke and/or ribbons 24 held therein escape. The control arm attachment 33 moves the lid 29 of the receptacle 15 with speed and precision. It is preferable to utilize a control arm attachment 33 including a servo arm 34 to provide the appropriate amount of control and direction. For example, a NELSON™ heavy duty SSA125 single servo arm can be utilized since it is a universal servo arm 34, and can fit to any standard servo wheel with screws and elastic stop nuts. The NELSON™ heavy duty SSA125 single servo arm is robust and made from 1/16" 2024T-3 aircraft grade aluminum.

A fourth pulse will move the second servo 14 from 90 to 180 degrees, which activates the pilot ejection assembly 6 (explained above) to expel the pilot 16 from the pilot receptacle 5 to signify the end of the battle.

The servos 13, 14, receiver 4, and light source 12 are electrically connected to the processor 3 and power source 7. The electrical wiring to the central microprocessor 3 and power source 7 can be covered with a wire guide to protect the electronic components and also for greater aesthetic appeal.

When second servo 14 moves upon receiving the fourth pulse overall, the push rod 17 pulls the spring-loaded pull pin release 26. The pull pin 26 then releases the pilot assembly connected to the spring end 27 of the pull pin 26. The pilot assembly 6 is ejected from the pilot receptacle 5 and this signifies the end of the simulated battle; the loser of the battle being the plane 2 having its pilot assembly 6 ejected.

Figure 7:
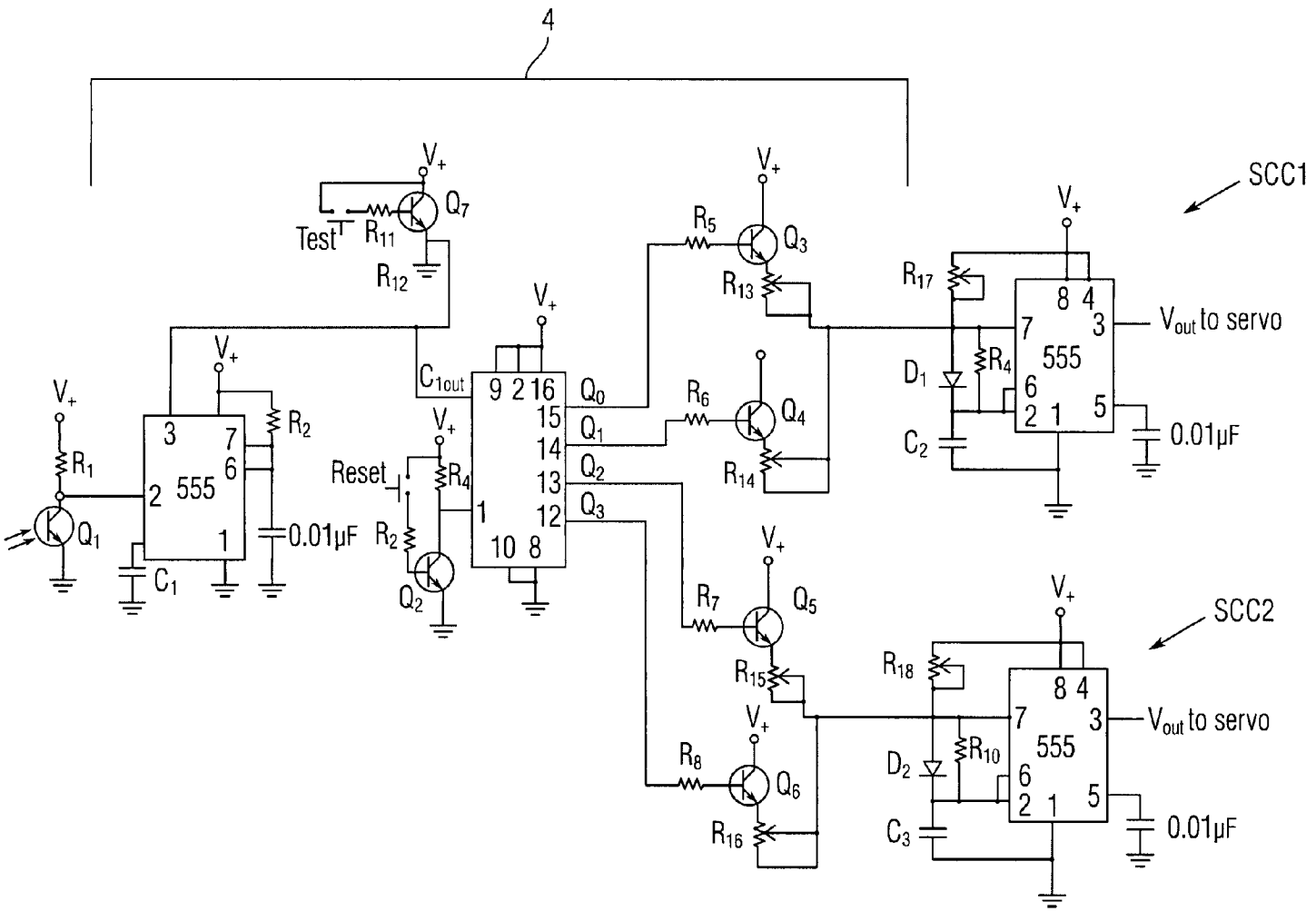
FIG. 7 is an exemplary circuit diagram of processor 3.

FIG. 7 is an exemplary circuit diagram of processor 3 showing the infrared receiver 4 connected to servo controllers SCC1 and SCC2 which output to servos 13, 14. IR radiation input to the receiver 4 gives an output to first 13 and second 14 servos (FIG. 1) to turn sequentially in 90 degree increments over 180 degrees with the first servo 13 completing its range of motion before the second servo 14 begins its motion. The servos 13, 14 and accompanying hit sequence is described in detail above.

The infrared receiver 4 circuit comprises a phototransistor Q1 that is optically sensitive to IR radiation. Phototransistor Q1 is connected across resistor R1 to bias voltage V+ for quick response. When Q1 receives IR radiation the power supply voltage V+ is sent to pin 2 of a timer T1, which is a conventional LM555 timer IC. Timer T1 is an 8-pin V package, and so timer T1 has eight connections (pins). Pin 1 is the ground (or common) pin and is connected to the circuit common (ground). Pin 2 is the trigger input pin, as it starts the timer T1. Pin 3 is the output pin which outputs a "high" clock pulse. The input at pin 2 sets the output at pin 3 to the high state. Pin 5 is a control voltage pin, which connects to a capacitor C1 and discharges to the ground. Pin 6 is the threshold pin, and voltage (of 0.01 micro Farads) can be applied pin 6 to end the timing interval and reset the timer T1. Pin 7 is the discharge pin and it is connected to a resistor R2 and to pin 6 which discharges to the ground. Pin 8 connects the timer T1 to a positive supply voltage V+which must be between +5V and +15V. Typically, LM555 timers include a reset pin, which applies a low reset pulse (0V) to terminate the output pulse. However the reset input pin is not used in timer T1 so that unwanted resetting does not occur.

Timer T1 is set to operate as a conventional monostable oscillator in "one shot" operation. A timer in monostable mode is useful for creating a time period of fixed duration in response to external events, which in the present invention include the receiver 4 receiving IR radiation from a light source 12 on an opponent aircraft. The RC time constant of resistor R2 in conjunction with capacitor C1 is 5 seconds, and as such all inputs to Pin 2 of the timer T1 are ignored for a period of 5 seconds. In other words, the receiver 4 is blind to IR radiation inputs that occur less than 5 seconds after the immediately prior input. This five-second delay allows for each "hit" (i.e. IR radiation input to receiver 4 which activates servos 13, 14) to be spaced apart, and thus creates a more realistic dogfight wherein an aircraft is typically fired at over a period of time before smoke is released and the pilot escapes from the airplane.

The output from Pin 3 of timer T1 is a "high" clock pulse. This pulse is inputted into a test circuit TEST and to a counter CNT1 which may be a type 4022 CMOS octal (divide by eight) counter. Test circuit TEST is used to test the transistor Q7 and troubleshoot the following parameters: gain, leakage, breakdown, and switching time. These parameters should be monitored for purposes of maintenance and repair of the transistor Q7. Test circuit TEST includes a transistor Q7 connected to a positive supply voltage V+. Transistor Q7 is connected to resistors R10 and R11. Resistor R10 connects to ground and resistor R11 is in series with a pushbutton switch S1, which is used for testing the circuit TEST. When the switch S1 is open, little or no current will flow in transistor Q7. When the switch S1 is depressed, the TEST circuit is closed, and current should flow in transistor Q7. An ohmmeter can be connected to the circuit TEST and used in conjunction with switch S1 to test the gain and junction resistance of transistor Q7. Any commercially available pushbutton switch, including for example the JUDCO Manufacturing Inc. J-188-1 switch, may be utilized with the present invention.

Counter CNT1 is a 4022 CMOS octal (divide by eight) counter with 16 connections (pins), and it is utilized to count the number of times the phototransistor Q1 receives an optical signal. The clock pulse enters the counter CNT1 at a Pin 3. Pins 9, 2, and 16 connect to a positive supply voltage V+which must be between +5V and +15V. Pins 8 and 10 connect to ground. Pin 1 connects to a reset circuit RESET. Circuit RESET resets the counter CNT1. Counter CNT1 counts the number of hits, and it must be reset after each hit sequence is completed. Resetting can be accomplished by the reset circuit RESET or alternatively by the central microprocessor 3. Circuit RESET includes a pushbutton switch S2 connected in series to resistor R3 which is connected to a transistor Q2, resistor R4, and a positive supply voltage V+. Pushbutton switch S2 allows for manual resetting. Transistor Q2 connects to ground. When pushbutton switch S2 is manually depressed, it completes a low impedance connection from Pin 1 to ground, forcing circuit RESET and consequently counter CNT1 to reset timing interval. Alternately if the switch S2 is not manually depressed, the circuit RESET will activate after all of the output pulses QA-QD are sent and processed through servo controller circuits SCC1 and SCC2. Pins 12, 13, 14, and 15 output pulses QA-QD. Counter CNT1 is preferably set up such that its outputs QA-QD start at zero and with each clock pulse increase in sequential order, remaining on until the cycle is completed or the reset button on the counter CNT1 is manually pressed, at which time all outputs QA-QD return to zero again. Counter CNT1 sends outputs QA and QB into the servo control inputs at transistors Q3 and Q4, respectively of servo controller circuit SCC1. Counter CNT1 sends outputs QC-QD into the servo control inputs at transistors Q5 and Q6 of servo controller circuit SCC2. The servo controller circuits SCC1 and SCC2 operate the servos 13, 14, respectively based on which "hit" (i.e. first, second, third, or fourth) in the sequence occurred. Servo controller circuit SCC1 comprises transistors Q3 and Q4 each connected across resistors R5, R13 and R6, R14 respectively, to bias voltage V+. Output QA from Pin 15 of counter CNT1 is sent to transistor Q3, and output QB from Pin 14 is sent to transistor Q4. The output from transistors Q3 and Q4 is sent to Pin 2 of timer T2, after passing through diode D1 connected in parallel to resistor R9. Servo controller circuit SCC2 comprises transistors Q5 and Q6 each connected across resistors R7, R15 and R8, R16 respectively, to bias voltage V+. Output QC from Pin 13 of counter CNT1 is sent to transistor Q5, and output QD is sent to transistor Q6. The output from transistors Q5 and Q6 is sent to Pin 2 of timer T3, after passing through diode D2 connected in parallel to resistor R10. Diodes D1 and D2 restrict the direction of movement of charge carriers and thereby allow an electric current to flow in one direction, while blocking current in the opposite direction. Timers T2 and T3 are conventional LM555 timers IC operating in the astable mode.

Timers T2 and T3 are 8-pin V packages. Pin 8 connects both timers T1 and T2 to a positive supply voltage V+which must be between +5V and +15V. Reset pin 4 is connected to resistors R17 and R18 of timers T1 and T2, respectively. Pin 1 is the ground (or common) pin and is connected to the circuit common (ground). Pin 5 control voltage at 0.01 microFarads. Pin 7 is the discharge pin, and pin 6 is the threshold pin which connects to input pin 2 of timers T2 and T3, respectively. Pin 3 is the output pin which outputs pulse signals to servos 13, 14, in order to control their motion.

When QA-QD are low, transistors Q3-Q6 are off and only resistors R9 and RIO, along with their respective capacitor (C2 and C3) determine the RC constant. The resistance of R9 and R10 is 2.9 kiloOhms. These chosen resistance values yield a low output lasting 2 ms. The resistance value of R17 and R18 is 0.5 kiloOhms. The values chosen for resistors R17 and R18 together with resistors R9 and R10 and capacitors C2 and C3 give a timer output that is high for 20 ms. When the counter CNT1 outputs a high charge QA, transistor Q3 is switched on and resistor R13 is in parallel with resistor R9 and reduces the time constant of the low output of the timer T1 to 1.5 ms. When QB is high, transistor Q4 is activated and resistor R14 is in parallel with resistors R9 and R13, further reducing the time constant to 1 ms. The same operation is carried out with the second servo controller circuit SCC2 when QC and QD are high. Second controller circuit SCC2 only operates after the function of SCC1 is complete. When the second controller circuit SCC2 completes its operation, the counter CNT1 in the receiver 4 resets. Thus, the next optical pulse that Q1 receives will operate SCC1 and hence first servo 13.

The timers T2 and T3 take in voltage at Pin 2 and generate output pulses at Pin 3 which are sent over the servos' 13, 14 control wires which connect to servo controller circuits SCC1 and SCC2. The inner mechanics of the servos 13, 14 control the position of servos 13, 14 in response to the output pulses.

When phototransistor Q1 is pulsed with constant IR radiation, servo 13 will move 90 degrees; five seconds later it will move another 90 degrees to complete its motion; five seconds later the second servo 14 will move 90 degrees, pause another 5 seconds, and then servo 14 will move another 90 degrees, thereby completing the function of the receiver circuit 4. Phototransistor Q1 can receive constant or intermittent pulses, however the minimum amount of time between servo motions is 5 seconds. Q1 can receive IR, move first servo 13 90 degrees, then 10 seconds later be irradiated again and servo 13 will move another 90 degrees. However if Q1 is irradiated and servo 13 moves 90 degrees, the receiver circuit 4 will ignore any subsequent pulses for 5 seconds. After a five-second interval has passed, servo 13 will move from 90 to 180 degrees to complete its motion.

The theatrical smoke release from receptacle 5, ejection of the pilot assembly 6, release of ribbons 24, and lights 8 provides visual effects of firing and being tagged. The servos 13, 14 can be altered to provide for varied game play. In addition to providing entertainment, the above disclosed system 1 can also have military applications and function as a safe method of simulating realistic air combat.

The present invention can be constructed utilizing any type of RC model aircraft 2. One can assemble the RC plane 2 entirely or buy an Almost Ready to Fly (ARF) plane or pre-assembled Ready To Fly (RTF) plane. Various types of ARF planes are sold and include Lanier RC, Carl Goldberg Products, Great Planes, and Sig Manufacturing. A number of different brands of RTF are also sold and may be utilized in constructing the present invention, including Great Planes, Hobbico, E-Flite, Hangar 9, Grand Wing Servo-Tech, HobbyZone and ParkZone. The light source 12 and receiver 4 must both be on the same frequency so the plane 2 can be controlled. RC aircraft 2 in the USA utilize a 72 MHZ frequency band for communication. The radio of the light source 12 broadcasts on AM, FM using PPM or PCM. Each aircraft 2 should have a flight channel, or sub-channel (range of frequency) to determine which light source 12 to receive communications from. A crystal is put into the light source 12 to allow it to communicate at a specific sub-channel to match the receiver 4 in the aircraft 2. This avoids transmitters 12 on different planes from trying to control the same craft 2, and prevents a possible crash.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A radio-controlled aircraft, comprising:

a scale model aircraft with fuselage, wings, gas engine, and motion-control servos for controlling flight;

a handheld radio controller including a pair of joysticks for controlling said motion-control servos, and at least one auxiliary firing control;

an optical transmitter mounted on said scale model aircraft and selectively illuminated by said auxiliary firing control to simulate a weapon firing;

an optical receiver mounted on said scale model aircraft for receiving illumination from other aircraft;

a processor in communication with said optical receiver for calculating hits from said other aircraft;

at least one servo motor electrically connected to said processor;

a pilot ejection mechanism including a spring-loaded pilot doll with parachute, and an ejection assembly mechanically connected to said servo motor for ejecting said pilot doll from said scale model aircraft when said processor has calculated a predetermined number of hits from said other aircraft.

2. The radio-controlled aircraft according to claim 1, wherein said at least one servo motor electrically connected to said processor further comprises a first servo motor coupled to said pilot ejection mechanism, and a second servo motor coupled to a streamer release assembly for releasing a streamer from said scale model aircraft when said processor has calculated a predetermined number of hits from said other aircraft.

3. The radio-controlled aircraft according to claim 2, wherein said processor releases said streamers and ejects said pilot doll according to a predefined sequence.

4. The radio-controlled aircraft according to claim 3, wherein said predefined sequence includes a first step of releasing said streamer after a first number of hits, and a second step of ejecting said pilot doll after a greater second number of hits.

5. A radio-controlled aircraft, comprising:

a scale model aircraft with fuselage, wings, gas engine, and motion-control servos for controlling flight;

a handheld radio controller including a pair of joysticks for controlling said motion-control servos, and at least one auxiliary firing control;

an optical transmitter mounted on said scale model aircraft and selectively illuminated by said auxiliary firing control to simulate a weapon firing;

an optical receiver mounted on said scale model aircraft for receiving illumination from other aircraft;

a processor in communication with said optical receiver for calculating hits from said other aircraft;

at least one servo motor electrically connected to said processor; and a streamer release assembly coupled to said at least one servo motor for releasing a streamer from said scale model aircraft when said processor has calculated a predetermined number of hits from said other aircraft.

6. The radio-controlled aircraft according to claim 5, wherein said at least one servo motor electrically connected to said processor further comprises a first servo motor coupled to said streamer release assembly, and a second servo motor coupled to a pilot ejection mechanism including a spring-loaded pilot doll with parachute, and an ejection assembly mechanically connected to said second servo motor for ejecting said pilot doll from said scale model aircraft when said processor has calculated a predetermined number of hits from said other aircraft.

7. The radio-controlled aircraft according to claim 6, wherein said processor releases said streamers and ejects said pilot doll according to a predefined sequence.

8. The radio-controlled aircraft according to claim 7, wherein said predefined sequence includes a first step of releasing said streamer after a first number of hits, and a second step of ejecting said pilot doll after a greater second number of hits.

9. A laser tag radio-controlled model aircraft system comprising:

a plurality of a scale model aircraft each having a fuselage, wings, gas engine, and motion-control servos for controlling flight;

a corresponding plurality of handheld radio controllers each including a pair of joysticks for controlling said motion-control servos, and at least one auxiliary firing control;

an optical transmitter mounted on each of said scale model aircraft and selectively illuminated by said auxiliary firing control to simulate a weapon firing;

an optical receiver mounted on each of said scale model aircraft for receiving illumination from the other aircraft;

a processor in each of said aircraft in communication with said optical receiver for calculating hits from said other aircraft;

at least one servo motor in each of said aircraft and electrically connected to said processor;

a pilot ejection mechanism in each of said aircraft and including a spring-loaded pilot doll with parachute, and an ejection assembly mechanically connected to said servo motor for ejecting said pilot doll from said scale model aircraft when said processor has calculated a predetermined number of hits from said other aircraft.

10. The laser tag radio-controlled model aircraft system according to claim 9, wherein said at least one servo motor electrically connected to each said processor further comprises a first servo motor coupled to said pilot ejection mechanism, and a second servo motor coupled to a streamer release assembly for releasing a streamer from said scale model aircraft when said processor has calculated a predetermined number of hits from said other aircraft.

11. The laser tag radio-controlled model aircraft system according to claim 10, wherein each said processor releases said streamers and ejects said pilot doll according to a predefined sequence.

12. The laser tag radio-controlled model aircraft system according to claim 11, wherein said predefined sequence includes a first step of releasing said streamer after a first number of hits, and a second step of ejecting said pilot doll after a greater second number of hits.

* * * * *